US009061173B1

(12) United States Patent
Felkel

(10) Patent No.: US 9,061,173 B1
(45) Date of Patent: Jun. 23, 2015

(54) BASKETBALL PLAYER TRAINING DEVICE

(71) Applicant: David S. Felkel, La Crescenta, CA (US)

(72) Inventor: David S. Felkel, La Crescenta, CA (US)

( * ) Notice: Subject to any disclaimer, the term of this patent is extended or adjusted under 35 U.S.C. 154(b) by 353 days.

(21) Appl. No.: 13/668,802

(22) Filed: Nov. 5, 2012

Related U.S. Application Data

(60) Provisional application No. 61/559,613, filed on Nov. 14, 2011.

(51) Int. Cl.
*A63B 21/02* (2006.01)
*A63B 21/055* (2006.01)
*A63B 69/00* (2006.01)

(52) U.S. Cl.
CPC ..... *A63B 21/0552* (2013.01); *A63B 21/0555* (2013.01); *A63B 21/0557* (2013.01); *A63B 69/0071* (2013.01)

(58) Field of Classification Search
CPC .. A63B 21/02; A63B 21/055; A63B 21/0552; A63B 21/0555; A63B 21/0557; A63B 69/0071
USPC ..... 482/44–50, 74, 92, 121–126; 434/248
See application file for complete search history.

(56) References Cited

U.S. PATENT DOCUMENTS

| | | | | |
|---|---|---|---|---|
| 4,164,043 | A | 8/1979 | Fujita | |
| 5,453,064 | A | 9/1995 | Williams, Jr. | |
| 5,647,827 | A * | 7/1997 | Gutkowski et al. | 482/124 |
| 5,792,034 | A * | 8/1998 | Kozlovsky | 482/124 |
| 5,813,955 | A * | 9/1998 | Gutkowski et al. | 482/124 |
| 5,820,522 | A * | 10/1998 | Smallwood et al. | 482/49 |
| 5,993,362 | A * | 11/1999 | Ghobadi | 482/124 |
| 6,287,242 | B1 * | 9/2001 | Fray | 482/121 |
| 6,550,651 | B1 | 4/2003 | Murdoch et al. | |
| 6,659,921 | B2 * | 12/2003 | Vernon | 482/124 |
| 6,802,442 | B1 | 10/2004 | Thompson | |
| 2005/0282689 | A1 * | 12/2005 | Weinstein | 482/124 |
| 2007/0004571 | A1 * | 1/2007 | Gonzalez | 482/124 |
| 2010/0222189 | A1 * | 9/2010 | Washington | 482/124 |
| 2012/0283077 | A1 * | 11/2012 | Cranke | 482/124 |
| 2013/0333097 | A1 * | 12/2013 | Cranke et al. | 2/300 |
| 2014/0243172 | A1 * | 8/2014 | Beroza et al. | 482/124 |

OTHER PUBLICATIONS

Theraband Consumer FAQ, http://www.thera-band.com/faqs_consumer.php, 2014.*

* cited by examiner

*Primary Examiner* — Oren Ginsberg
(74) *Attorney, Agent, or Firm* — Crossley Patent Law

(57) ABSTRACT

A basketball player training device including an adjustable waist belt; a harness including adjustable shoulder straps, each having a first D-ring disposed thereon; and a fingerless glove. A reinforcement member is disposed on a back side of the glove and an elastomeric securement band has a proximal end securely attached to the reinforcement member and a distal end to which a second D-ring is attached. Elastomeric resistance exercise bands are provided in a range of lengths directly correlated to resistance strengths that increases as the length decreases. A quick-release clip disposed on outer ends of each exercise band engages a respective first D-ring and second D-ring. Each exercise band is configured to provide a variable resistance to strengthen a basketball player's shooting arm and to develop muscle memory in the finger, arm, and shoulder muscles required to correctly execute basketball shots.

9 Claims, 5 Drawing Sheets

BASKETBALL PLAYER TRAINING DEVICE

CROSS-REFERENCE TO RELATED APPLICATIONS

U.S. Provisional Application No. 61/559,613 filed Nov. 14, 2011

FEDERALLY SPONSORED RESEARCH OR DEVELOPMENT

Not Applicable

INCORPORATION BY REFERENCE OF MATERIAL SUBMITTED ON A COMPACT DISK

Not Applicable

BACKGROUND OF THE INVENTION

Various types of sports player training devices are known in the prior art. However, what is needed is an improved basketball player training device designed to strengthen the basketball shooting arm, to improve muscle memory in the finger, arm, and shoulder muscles required for basketball shooting movements, and to improve basketball dribbling skills.

FIELD OF THE INVENTION

The present invention relates to sports training devices, and more particularly, to a basketball player training device.

SUMMARY OF THE INVENTION

The general purpose of the present basketball player training device, described subsequently in greater detail, is to provide a basketball player training device which has many novel features that result in a basketball player training device which is not anticipated, rendered obvious, suggested, or even implied by prior art, either alone or in combination thereof.

To accomplish this, the present basketball player training device includes a length adjustable waist belt having a releasable buckle and a harness including a pair of length adjustable shoulder straps. A first D-ring and a loop member are disposed on each shoulder strap. The length of each shoulder strap slidingly engages the loop member to adjust the length of each shoulder strap. A fingerless glove includes a reinforcement member centrally disposed on an outer wall back side of a base portion and an elastomeric securement band having a proximal end securely attached to the reinforcement member and a distal end. A second D-ring is attached to the distal end. Finger-insertion bores are formed along a forward edge of the outer wall and a wrist band is attached to the glove base portion. A wrist strap extends from one of an inner side and an outer side of the wrist band. A first length of hook and loop fastener disposed on the outer side. A second length of hook and loop fastener is disposed on a bottom side of the wrist strap proximal to an outside edge thereof. The first and second lengths of hook and loop fastener securingly engage each other to secure the wrist band around a user's wrist.

A plurality of elastomeric resistance exercise bands are provided in a range of lengths, each of which is directly correlated to a resistance strength with the resistance strength increasing as the length decreases. A quick-release clip disposed on each of an outer end of each exercise band engages a respective one of the first D-ring and the second D-ring of one of the exercise bands. Each exercise band is configured to provide a variable resistance to strengthen a basketball player's shooting arm and to develop muscle memory in the finger, arm, and shoulder muscles required for playing basketball. A storage bag configured to accommodate storage of the waist belt, the harness, the glove, and the exercise bands is also provided.

Thus has been broadly outlined the more important features of the present basketball player training device so that the detailed description thereof that follows may be better understood and in order that the present contribution to the art may be better appreciated.

BRIEF DESCRIPTION OF THE DRAWINGS

Figures

DETAILED DESCRIPTION OF THE DRAWINGS

Figure 1:
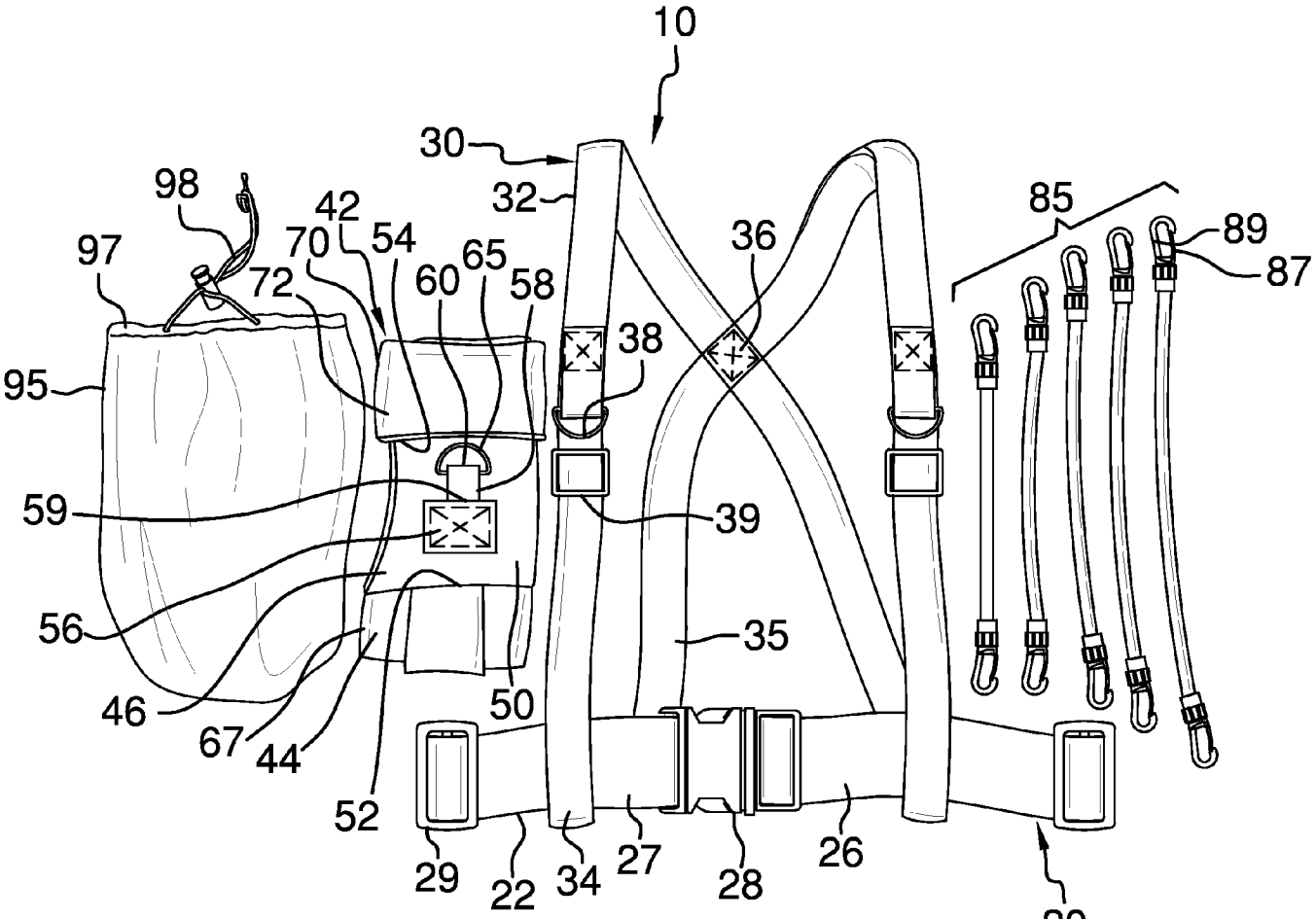
FIG. 1 is a front elevation view of components of the present device.
Figure 2:
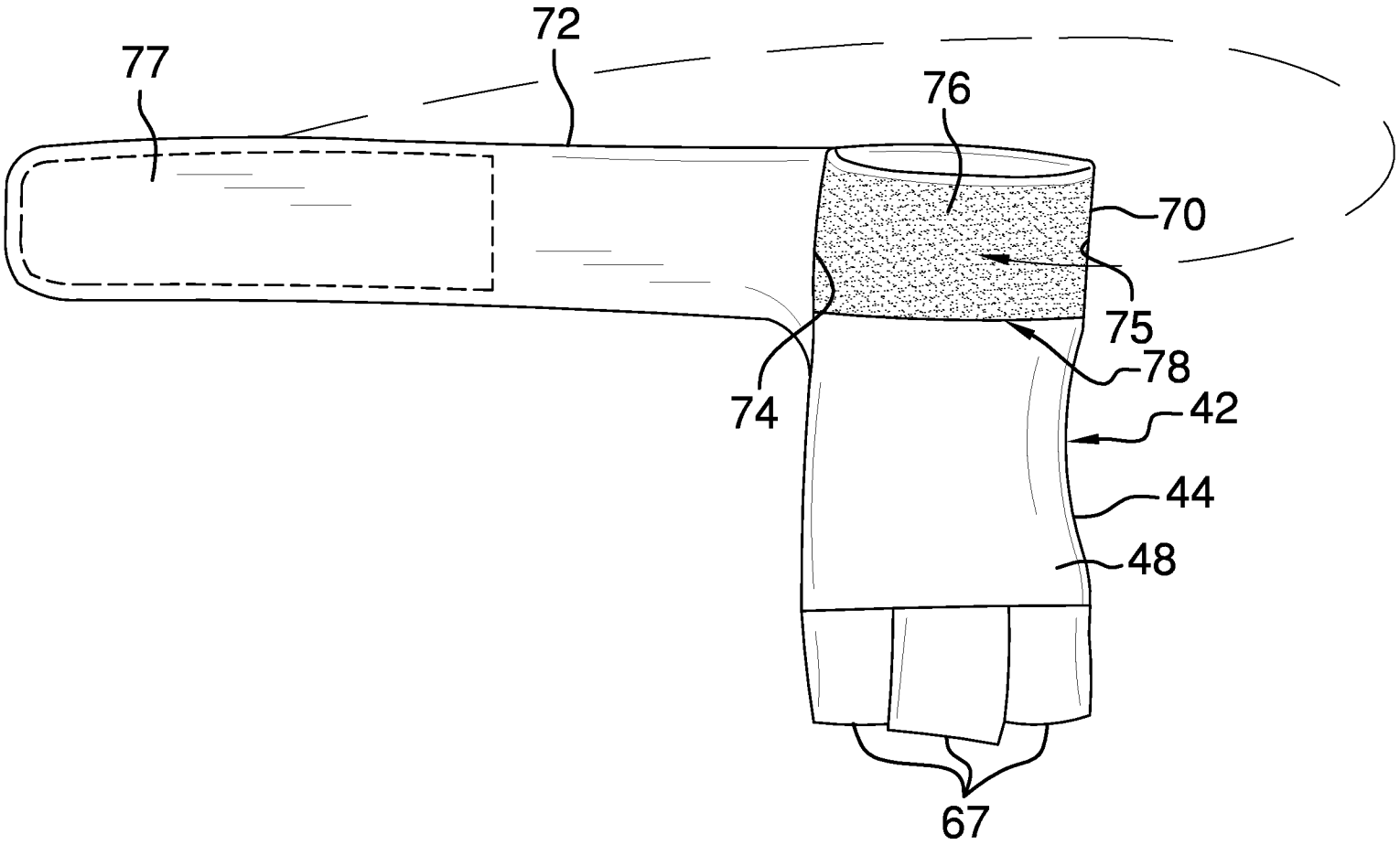
FIG. 2 is a side elevation view of a glove.
Figure 3:
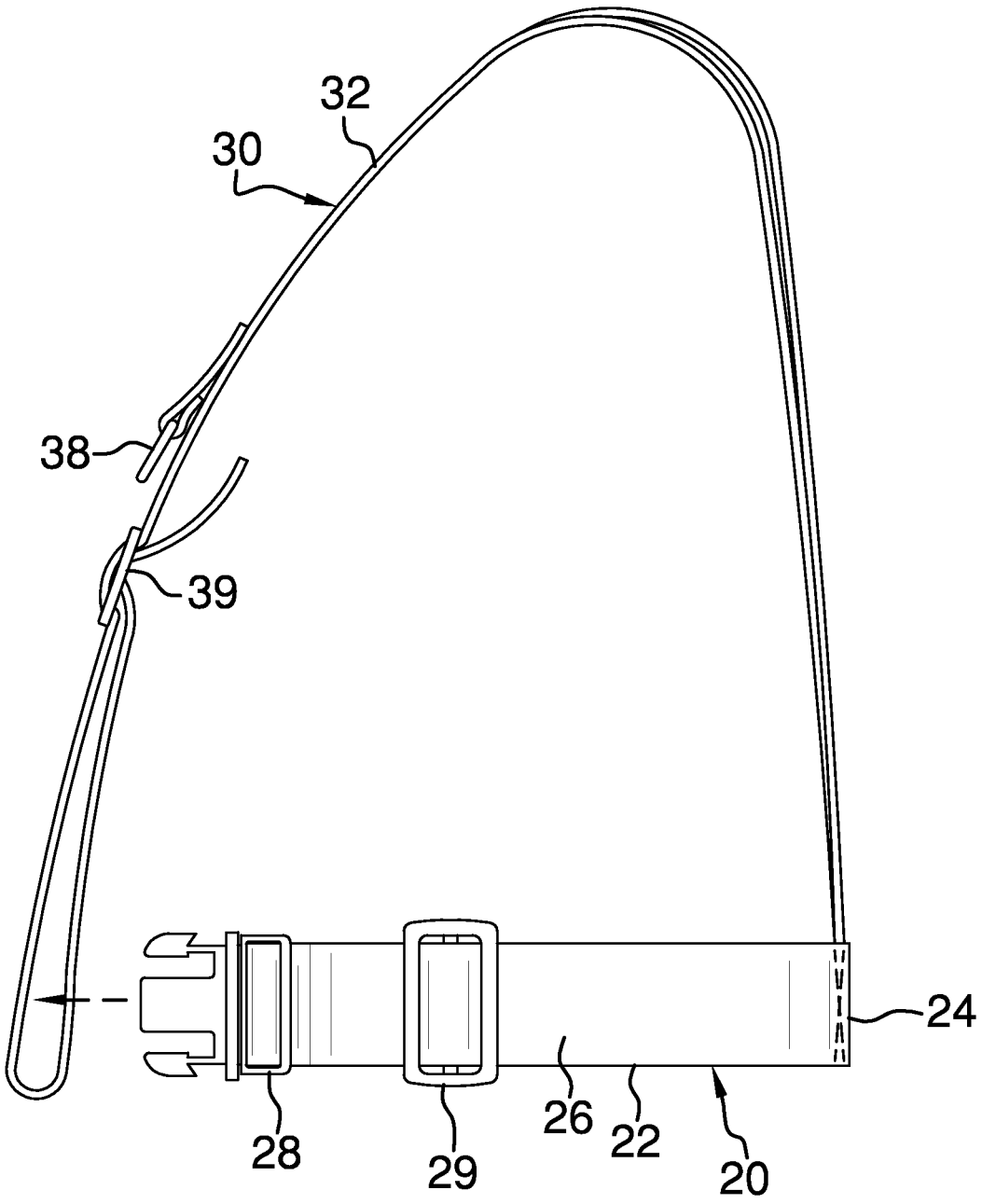
FIG. 3 is a side elevation view of a shoulder strap attached to a waist belt.
Figure 4:
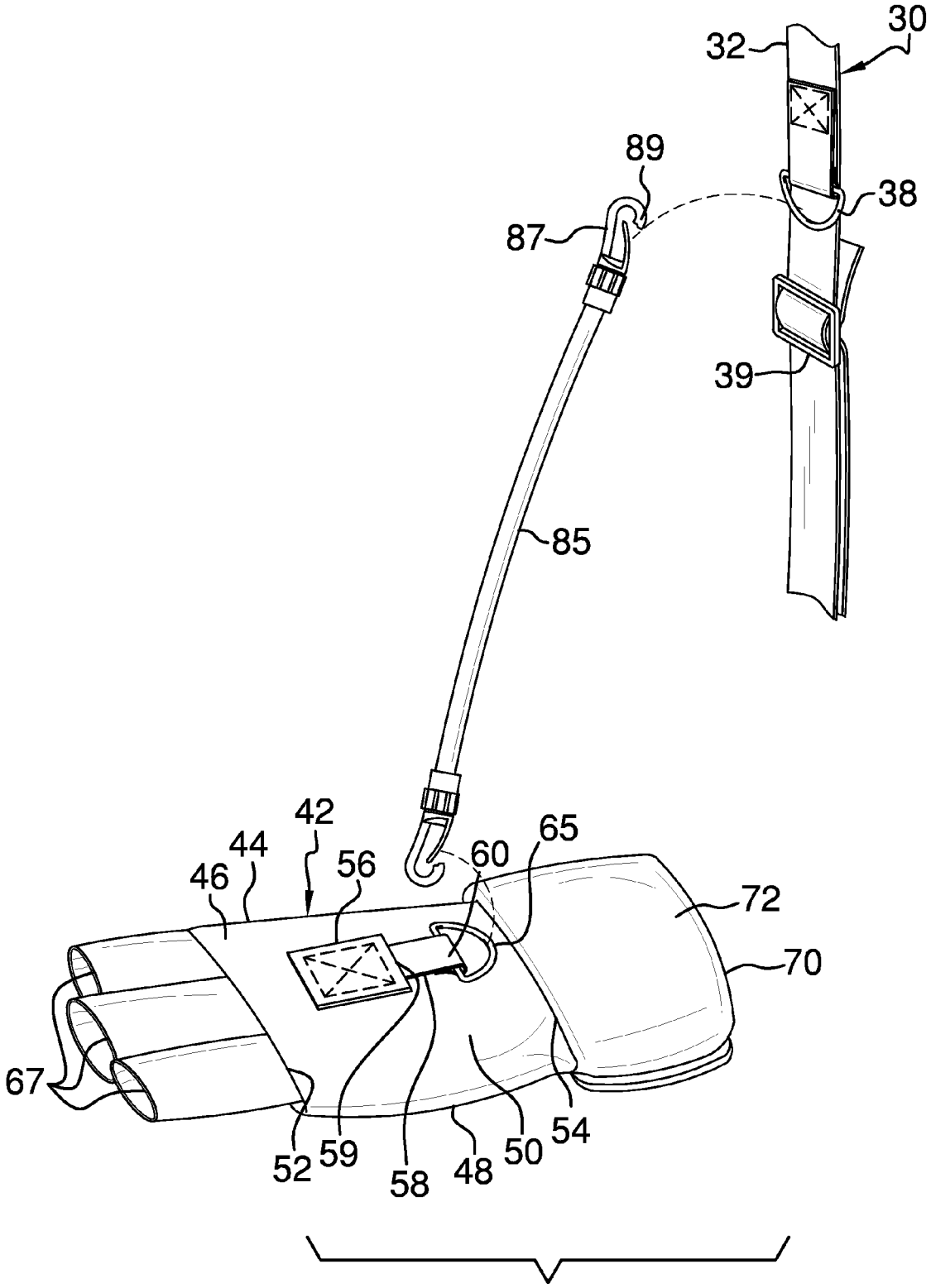
FIG. 4 is an exploded isometric view of a resistance band being attached to the glove and to the shoulder strap.
Figure 5:
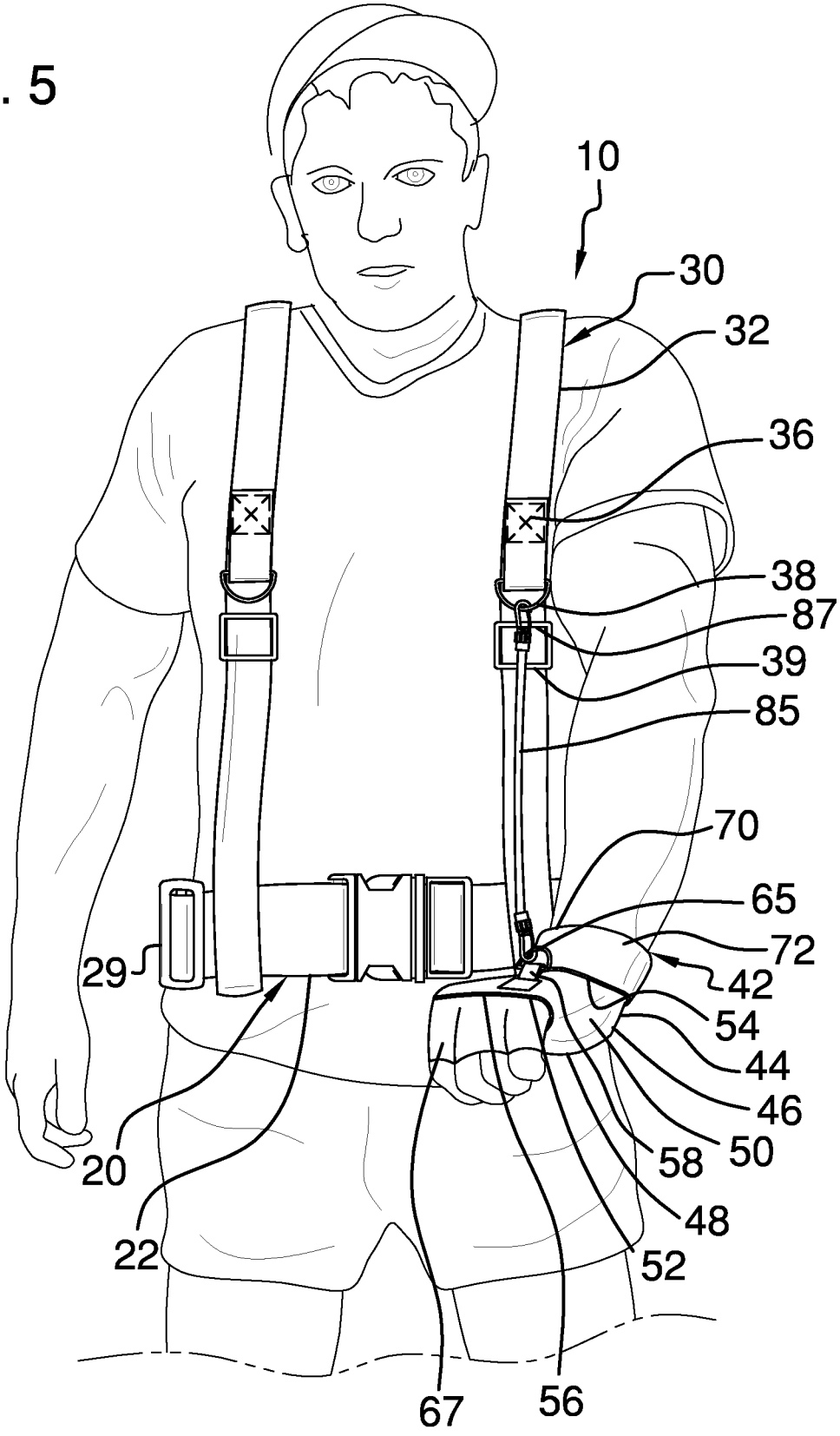
FIG. 5 is an in-use isometric view.

With reference now to the drawings, and in particular FIGS. 1 through 5 thereof, example of the instant basketball player training device employing the principles and concepts of the present basketball player training device and generally designated by the reference number 10 will be described.

Referring to FIGS. 1 through 5 a preferred embodiment of the present basketball player training device 10 is illustrated. The basketball player training device 10 includes a length adjustable waist belt 20 having a front portion 22 and a rear portion 24. The front portion 22 has right side 26 and a left side 27. A buckle 28 is disposed between the right side 26 and the left side 27 resulting in the left side 27 and the right side 26 being separable from each other. A waist adjustment loop 29 is disposed on each of the right side 26 and the left side 27 and is configured to adjust the length of the waist belt 20.

The present device 10 also includes a harness 30. The harness 30 includes a pair of length adjustable shoulder straps 32. Each shoulder strap 32 has a forward end 34, a rearward end 35, and a reinforced connection portion 36 between the forward end 34 and the rearward end 35. The forward end 34 slidingly, removably engages one of the right side 26 and the left side 27. The rearward end 35 of each shoulder strap 32 is disposed in a position spaced apart from each other on the rear portion 24 of the waist belt 20. The connection portion 36 of each shoulder strap 32 is attached together in an X-shaped configuration. A first D-ring 38 is disposed on each shoulder strap 32 between the forward end 34 and the connection portion 36. A loop member 39 is disposed on each of the shoulder straps 32. The length of each shoulder strap 32 slidingly engages the loop member 39. The loop member 39 is configured to adjust the length of each shoulder strap 32.

A fingerless glove 42 configured to receive one of a user's right hand or left hand therethrough is also included in the prevent device 10. The glove 42 includes a base portion 44 having a continuous outer wall 46. The outer wall 46 has a palm side 48, a back side 50, a forward edge 52, and a rearward edge 54. The base portion 44 is configured to continuously receive both a back portion and a palm portion of a user's hand therethrough. A reinforcement member 56 is centrally disposed on the back side 50 of the outer wall 46. An elastomeric securement band 58 has a proximal end 59 securely attached to the reinforcement member 56 and a distal end 60.

A second D-ring 65, which is disposed on the back side 50 of the outer wall 46, has a linear portion attached to the distal end 60 of the securement band 58. A plurality of finger-insertion bores 67 is formed along the forward edge 52 of the outer wall 46. A wrist band 70 is continuously disposed along the base portion 44 rearward edge 54. A wrist strap 72 extends from one of an inner side 74 and an outer side 75 of the wrist band 70. The wrist strap 72 securingly engages an outside wall 78 of the wrist band 70. The first length of hook and loop fastener 76 is continuously disposed on the outside wall 78 of the wrist band 70. The second length of hook and loop fastener 77 is disposed on a bottom side 79 of the wrist strap 72 proximal to an outside edge 81 of the wrist strap 72. The first and second lengths of hook and loop fastener 76, 77 securingly engage each other. The wrist strap 72 is configured to secure the wrist band 70 around a user's wrist.

A plurality of elastomeric resistance exercise bands 85 is further included in the present basketball player training device 10. Each exercise band 85 has a clip 87, including a quick-release clip 89, on each of an outer end 90 thereof. Each clip 87 engages a respective one of the first D-ring 38 and the second D-ring 65 of one of the exercise bands 85. Each of the exercise bands 85 has a different length from a length of each of the other exercise bands 85.

The exercise bands 85 are provided in a range of lengths, each length directly correlated to a resistance strength, which increases as the lengths of the exercise bands 85 decreases. Each exercise band 85 is configured to provide a variable resistance to strengthen a basketball player's shooting arm and to develop muscle memory in the finger, arm, and shoulder muscles required for playing basketball. A storage bag 95 is provided configured to accommodate storage of the waist belt 20, the harness 30, the glove 42, and the exercise bands. An upper perimeter 97 of the storage bag 95 has a draw string closure 98.

The waist belt 20 has a length in a range of approximately 45 inches to 55 inches and a width in a range of 1.75 inches to 2.25 inches. The buckle 28 has a width that will accommodate the waist belt 20 for proper buckling. Each shoulder strap 32 has a width in a range of approximately 0.75 inches to 1.25 inches and a length in a range of 24 inches to 26 inches. Each loop member 39 has a diameter sized to accommodate the width of the respective shoulder strap 32.

In addition, the exercise bands 85 are provided in a diameter of approximately ⅜ inch and in lengths of approximately 8½ inches, 9½ inches, 10½ inches, 11½ inches, and 12½ inches. The clip 87 disposed on each outer end 90 of each exercise band 85 has a diameter of approximately ⅝ inch and a length of approximately 2 inches. Each of the first D-ring 38 and the second D-ring 65 has a diameter sized to accommodate one of the clips 87 disposed on the outer end 90 of the respective exercise band 85. The glove 42 has a width in a range of approximately 3 inches to 4 inches and a length in a range of approximately 7 inches to 8 inches.

Use:

To use the present basketball player training device 10, a basketball player places each shoulder strap 32 over a respective one of his shoulders. The basketball player also adjusts the length of the waist belt 20 and secures the waist belt 20 around his waist. The basketball player adjusts and latches the buckle 28 and each loop member 39 to secure the respective waist belt 20 and shoulder strap 32 in place. The user secures one of the clips 87 disposed on the outer end 90 of exercise band 85 to each of the first D-ring 38 and the second D-ring 65. The user places each of the forefinger, the middle finger and ring finger together, and the little finger through the respective glove 42 finger-insertion bore 67 with the outer wall 46 rearward edge 54 of the glove 42 in a position proximal to the player's wrist and the outer wall 46 back side 50 and palm side 48 atop the user's hand back portion and proximal the hand palm portion, respectively.

The basketball player repeatedly extends his shooting arm in a motion to shoot a basketball into a basketball net and alternatively to dribble a basketball thereby reinforcing muscle memory to teach the basketball player correctly executed basketball shots and dribbling position while building strength in the shooting arm. The exercise band 85 provides resistance against shooting arm extension thereby increasing the resistance strength thereof. The basketball player retracts his shooting arm to reduce the resistance strength provided by the exercise band 85.

What is claimed is:

1. A basketball player training device comprising:

a length adjustable waist belt having a front portion and a rear portion, the front portion having a right side and a left side;

a buckle disposed between the right side and the left side, wherein the right side and the left side are separable from each other;

a harness comprising:

a pair of length adjustable shoulder straps;

wherein each shoulder strap has a forward end, a rearward end, and a connection portion between the forward end and the rearward end, the forward end slidingly, removably engaging one of the right side and the left side, the rearward end of one of the pair of shoulder straps spaced apart from the rearward end of the other one of the pair of shoulder straps on the rear portion of the waist belt;

wherein the connection portion of each shoulder strap is attached together in an X-shaped configuration;

a first D-ring disposed on each shoulder strap between the forward end and the connection portion;

a fingerless glove configured to receive one of a user's right hand or left hand therethrough, the glove comprising:

a base portion having a continuous outer wall, the outer wall having a palm side, a back side, a forward edge, and a rearward edge, wherein the base portion is configured to continuously receive both a back portion and a palm portion of a user's hand back therethrough;

a reinforcement member centrally disposed on the back side of the outer wall;

an elastomeric securement band having a proximal end securely attached to the reinforcement member and a distal end;

a second D-ring disposed on the back side of the outer wall, the second D-ring having a linear portion attached to the distal end of the securement band;

a plurality of finger-insertion bores formed along the forward edge of the outer wall;

a wrist band continuously disposed along the base portion rearward edge;

a plurality of elastomeric resistance exercise bands, each exercise band having a clip on each of an outer end thereof, wherein each of the exercise bands has a different length from a length of each of the other exercise bands, wherein the exercise bands are in a range of lengths directly correlated to a resistance strength, wherein the resistance strength increases as the lengths of the exercise bands decreases;

and wherein each clip engages a respective one of the first D-ring and the second D-ring of one of the exercise bands.

2. The basketball player training device of claim 1 further comprising a wrist strap extending from one of an inner side and an outer side of the wrist band, wherein the wrist strap securingly engages an outside wall of the wrist band.

3. The basketball player training device of claim 1 further comprising a loop member disposed on each of the shoulder straps wherein a length of each shoulder strap slidingly engages the loop member; wherein the loop member is configured to adjust the length of each shoulder strap.

4. The basketball player training device of claim 1 wherein each exercise band is configured to provide a variable resistance to strengthen a basketball player's shooting arm and to develop muscle memory in the finger, arm, and shoulder muscles required for playing basketball.

5. The basketball player training device of claim 1 wherein each clip is a quick-release clip.

6. The basketball player training device of claim 2 wherein a first length of hook and loop fastener is continuously disposed on an outside wall of the wrist band;

wherein a second length of hook and loop fastener is disposed on a bottom side of the wrist strap proximal to an outside edge of the wrist strap;

wherein the first and second lengths of hook and loop fastener securingly engage each other; and wherein the wrist strap is configured to secure the wrist band around a user's wrist.

7. A basketball playing training device comprising:

a length adjustable waist belt having a front portion and a rear portion, the front portion having a right side and a left side;

a buckle disposed between the right side and the left side, wherein the right side and the left side are separable from each other;

a harness comprising:

a pair of length adjustable shoulder straps;

wherein each shoulder strap has a forward end, a rearward end, and a connection portion between the forward end and the rearward end, the forward end slidingly, removably engaging one of the right side and the left side, the rearward end of one of the pair of shoulder straps spaced apart from the rearward end of the other one of the pair of shoulder straps on the rear portion of the waist belt in a position spaced apart from each other;

wherein the connection portion of each shoulder strap is attached together in an X-shaped configuration;

a first D-ring disposed on each shoulder strap between the forward end and the connection portion;

a loop member disposed on each of the shoulder straps wherein a length of each shoulder strap slidingly engages the loop member; wherein the loop member is configured to adjust the length of each shoulder strap;

a fingerless glove configured to receive one of a user's right hand or left hand therethrough, the glove comprising:

a base portion having a continuous outer wall, the outer wall having a palm side, a back side, a forward edge, and a rearward edge, wherein the base portion is configured to continuously receive both a back portion and a palm portion of a user's hand back therethrough;

a reinforcement member centrally disposed on the back side of the outer wall;

an elastomeric securement band having a proximal end securely attached to the reinforcement member and a distal end;

a second D-ring having a linear portion attached to the distal end of the securement band, wherein the second D-ring is disposed on the back side of the outer wall;

a plurality of finger-insertion bores formed along the forward edge of the outer wall;

a wrist band continuously disposed along the base portion rearward edge;

a wrist strap extending from one of an inner side and an outer side of the wrist band, wherein the wrist strap securingly engages the wrist band outer side;

wherein a first length of hook and loop fastener is continuously disposed on an outside wall of the wrist band;

wherein a second length of hook and loop fastener is disposed on a bottom side of the wrist strap proximal to an outside edge of the wrist strap;

wherein the first and second lengths of hook and loop fastener securingly engage each other;

wherein the wrist strap is configured to secure the wrist band around a user's wrist;

a plurality of elastomeric resistance exercise bands, each exercise band having a quick-release clip on each of an outer end thereof, wherein each of the exercise bands has a different length from a length of each of the other exercise bands, wherein the exercise bands are in a range of lengths directly correlated to a resistance strength, wherein the resistance strength increases as the lengths of the exercise bands decreases; and wherein each clip engages a respective one of the first D-ring and the second D-ring of one of the exercise bands.

8. The basketball player training device of claim 7 wherein each exercise band is configured to provide a variable resistance to strengthen a basketball player's shooting arm and to develop muscle memory in the finger, arm, and shoulder muscles required for playing basketball.

9. The basketball player training device of claim 7 wherein the connection portion is reinforced.

* * * * *